US009624816B2

(12) United States Patent
Matsumoto et al.

(10) Patent No.: US 9,624,816 B2
(45) Date of Patent: Apr. 18, 2017

(54) COOLING DEVICE FOR MULTI-CYLINDER ENGINE

(71) Applicant: Mazda Motor Corporation, Hiroshima (JP)

(72) Inventors: Daisuke Matsumoto, Hiroshima (JP); Daisuke Tabata, Hiroshima (JP); Masahiro Naito, Hiroshima (JP)

(73) Assignee: MAZDA MOTOR CORPORATION, Hiroshima (JP)

( * ) Notice: Subject to any disclaimer, the term of this patent is extended or adjusted under 35 U.S.C. 154(b) by 28 days.

(21) Appl. No.: 14/760,943

(22) PCT Filed: Feb. 7, 2014

(86) PCT No.: PCT/JP2014/000673
§ 371 (c)(1),
(2) Date: Jul. 14, 2015

(87) PCT Pub. No.: WO2014/129139
PCT Pub. Date: Aug. 28, 2014

(65) Prior Publication Data

US 2016/0010533 A1 Jan. 14, 2016

(30) Foreign Application Priority Data

Feb. 21, 2013 (JP) ..... 2013-031899

(51) Int. Cl.
*F01P 3/02* (2006.01)
*F01P 7/16* (2006.01)
(Continued)

(52) U.S. Cl.
CPC *F01P 3/02* (2013.01); *F01P 5/10* (2013.01); *F01P 7/16* (2013.01); *F02F 1/14* (2013.01);
(Continued)

(58) Field of Classification Search
CPC F01P 3/02; F01P 7/16; F01P 2003/021; F01P 2003/024; F01P 2003/028;
(Continued)

(56) References Cited

U.S. PATENT DOCUMENTS 4,455,972 A * 6/1984 Kawakami ..... F01P 3/02 123/41.29
6,397,792 B1 * 6/2002 Heinemann ..... F02F 1/14 123/41.74
(Continued)

FOREIGN PATENT DOCUMENTS

CN 102072002 A 5/2011
CN 102072040 A 5/2011
(Continued)

OTHER PUBLICATIONS

Machine translation, JP2009243414 Description, Tsuboi, H., Oct. 22, 2009, pp. 1-13.*
(Continued)

*Primary Examiner* — Grant Moubry
(74) *Attorney, Agent, or Firm* — Studebaker & Brackett PC

(57) ABSTRACT

A cylinder block (3) includes an inlet portion (36), a narrow portion (42), and an inclined portion (43). A cylinder head includes a head-side discharge portion. The inlet portion is formed on the first cylinder side of a cylinder array, and introduces coolant to a block-side water jacket (33). The narrow portion is formed in the vicinity of the inlet portion, and restricts the coolant introduced through the inlet portion from flowing to an intake-side channel (35) of the block-side water jacket. The inclined portion is formed in the vicinity of the inlet portion, and guides the coolant introduced through the inlet portion toward the head. The head-side discharge portion is formed on the fourth cylinder side of the cylinder array, and discharges the coolant from a head-side
(Continued)

water jacket. A communication path for communicating between the water jackets is formed on the head side of the inclined portion.

10 Claims, 13 Drawing Sheets

(51) Int. Cl.
*F01P 5/10* (2006.01)
*F02F 1/14* (2006.01)

(52) U.S. Cl.
CPC ..... *F01P 2003/028* (2013.01); *F01P 2060/16* (2013.01)

(58) Field of Classification Search
CPC ..... F02F 1/02; F02F 1/10; F02F 1/14; F02F 1/166; F02F 2001/104
USPC ..... 123/41.02, 41.08, 41.28, 41.44, 41.72, 123/41.74, 41.79, 41.82 R, 193.5, 193.2, 123/193.3
See application file for complete search history.

(56) References Cited

U.S. PATENT DOCUMENTS

| | | | | |
|---|---|---|---|---|
| 7,216,611 | B2 * | 5/2007 | Matsutani | F02F 1/14 123/198 E |
| 7,237,511 | B2 * | 7/2007 | Aoki | B60H 1/00885 123/41.08 |
| 7,798,108 | B2 * | 9/2010 | Konishi | F02F 1/108 123/41.72 |
| 8,171,896 | B2 * | 5/2012 | Hanai | F02F 1/14 123/41.28 |
| 8,561,580 | B2 * | 10/2013 | Kakehashi | F01P 7/164 123/41.08 |
| 2006/0213460 | A1 | 9/2006 | Aoki et al. | |
| 2010/0242868 | A1 * | 9/2010 | Shikida | F01P 3/02 123/41.79 |
| 2011/0114043 | A1 | 5/2011 | Hamakawa et al. | |
| 2011/0132295 | A1 | 6/2011 | Hamakawa et al. | |
| 2015/0075454 | A1 | 3/2015 | Hamakawa et al. | |

FOREIGN PATENT DOCUMENTS

| | | | |
|---|---|---|---|
| JP | 2002-221079 | A | 8/2002 |
| JP | 2008-025474 | A | 2/2008 |
| JP | 2009-243414 | A | 10/2009 |
| JP | 2010-014067 | A | 1/2010 |

OTHER PUBLICATIONS

International Search Report of PCT/JP2014/000673 dated Mar. 4, 2014.

The First Office Action issued by the Chinese Patent Office on Dec. 23, 2016, which corresponds to Chinese Patent Application No. 201480006569.7 and is related to U.S. Appl. No. 14/760,943; with English language summary.

* cited by examiner

COOLING DEVICE FOR MULTI-CYLINDER ENGINE

TECHNICAL FIELD

The present invention relates to a cooling device for a multi-cylinder engine of an automobile or a like vehicle, and more particularly, to a technical field of engines configured to cool a cylinder head and a cylinder block by coolant.

BACKGROUND ART

Conventionally, in an automobile or a like vehicle, there is provided a cooling device configured to cool an engine by flowing coolant to an inside of the engine so as to obtain an appropriate temperature of the engine.

For instance, Patent Literature 1 discloses a technique, in which a spacer is disposed in a water jacket of a cylinder block. A guide slope portion for guiding coolant toward the cylinder head portion is formed on the coolant inlet portion of the spacer. A channel separation member constituting an upper channel of the water jacket continues to the upper end of the guide slope portion. According to this configuration, increasing the flow rate and the flow speed of coolant flowing through the upper channel of the water jacket while making a U-turn makes it possible to reduce a temperature difference between the upper portion and the lower portion of a cylinder.

CITATION LIST

Patent Literature

Patent Literature 1: Japanese Patent No. 4845620

SUMMARY OF INVENTION

Warming up an engine in an early stage when the engine is in a cold state is advantageous in the aspect of combustion performance and exhaust gas purification performance. In view of the above, there is a demand for a cooling device for an engine, which enables to effectively accelerate warming up of the engine when the engine is in a cold state.

Further, a cylinder head is exposed to high-temperature exhaust gas even when the engine is in a cold state. Therefore, cooling the cylinder head is also necessary. In view of the above, there is also a demand for a cooling device for an engine, which enables to effectively cool a cylinder head when the engine is in a cold state.

Consequently, an object of the present invention is to provide a cooling device for a multi-cylinder engine, which enables to effectively cool a cylinder head and accelerate warming up of the engine when the engine is in a cold state.

In order to solve the above problem, an aspect of the present invention is directed to a cooling device for a multi-cylinder engine, which is provided with a cylinder block including a block-side water jacket configured to surround a plurality of cylinder bores for an array of cylinders disposed in series; a cylinder head including a head-side water jacket; and a coolant channel for circulating coolant by a water pump via the block-side water jacket, the head-side water jacket, and a radiator.

The cylinder block includes an inlet portion formed on one end side of the cylinder array, and configured to introduce coolant to the block-side water jacket; a narrow portion formed in a vicinity of the inlet portion, and configured to restrict the coolant introduced through the inlet portion from flowing to an intake-side channel of the block-side water jacket, and an inclined portion formed in the vicinity of the inlet portion, and configured to guide the coolant introduced through the inlet portion toward the cylinder head.

The cylinder head includes a head-side discharge portion formed on the other end side of the cylinder array, and configured to discharge the coolant from the head-side water jacket; and a communication path formed on a cylinder head side of the inclined portion, and configured to communicate between the block-side water jacket and the head-side water jacket.

These and other objects, features and advantages of the present invention will become more apparent upon reading the following detailed description along with the accompanying drawings.

DESCRIPTION OF EMBODIMENTS

In the following, an embodiment of a cooling device for a multi-cylinder engine according to the invention is described referring to FIG. 1 to FIG. 15D.

Figure 1:
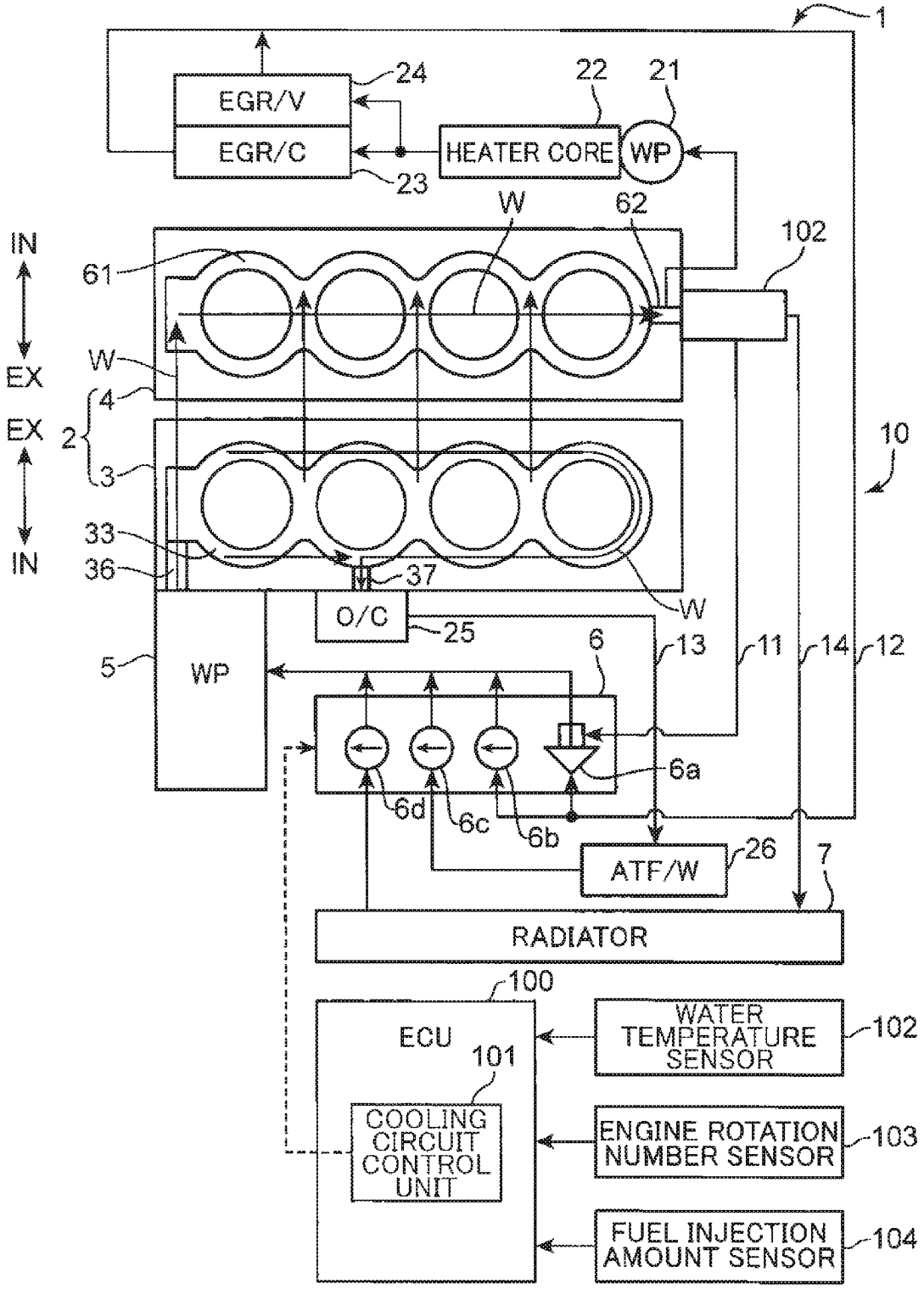
FIG. 1 is a block diagram illustrating a schematic configuration of a cooling device in an embodiment of the invention.

FIG. 1 is a diagram illustrating a schematic configuration of a cooling device 1 for a multi-cylinder engine 2 in an embodiment of the invention. The multi-cylinder engine 2 (hereinafter, simply called as an "engine") is a so-called cross flow type in-line 4-cylinder diesel engine, in which four cylinders are disposed in series in an unillustrated crankshaft direction (left and right directions in FIG. 1), and an intake system and an exhaust system are disposed opposite to each other with respect to a cylinder head 4. The engine 2 is loaded in an engine room (not illustrated) provided at a vehicle front portion in such a manner that an array of cylinders is aligned in the vehicle width direction, the exhaust system is located on the rear side in the vehicle front and rear directions, and a cylinder axis of each cylinder extends in up and down directions.

The engine 2 includes, as main constituent elements, a cylinder block 3, and the cylinder head 4 disposed above the cylinder block 3.

In FIG. 1, the cylinder block 3 is illustrated as viewed from above, and the cylinder head 4 is illustrated as viewed from below. Therefore, the positional relationship between the intake side (illustrated as "IN") and the exhaust side (illustrated as "EX") is reversed between the cylinder block 3 and the cylinder head 4.

The cylinder block 3 is provided with a block-side water jacket 33, an inlet hole (inlet portion) 36 of cooling water (coolant) W, and a block-side discharge hole (block-side discharge portion) 37. The cylinder head 4 is provided with a head-side water jacket 61, and a head-side discharge hole (head-side discharge portion) 62. As will be described later, cooling water W introduced to the inside of the block-side water jacket 33 through the inlet hole 36 is discharged through the block-side discharge hole 37. Cooling water W introduced to the inside of the head-side water jacket 61 through the inlet hole 36 is discharged through the head-side discharge hole 62.

A water pump (WP) 5 is disposed in the inlet hole 36 for supplying cooling water W to the inside of the block-side water jacket 33 and to the inside of the head-side water jacket 61. The water pump 5 is a pump to be driven by rotating the engine 2.

The cooling device 1 is provided with a cooling water channel (coolant channel) 10 for circulating cooling water W to the block-side water jacket 33 and to the head-side water jacket 61 via a radiator 7, as necessary. The cooling water channel 10 includes a first passage 11, a second passage 12, a third passage 13, and a fourth passage 14. The cooling water channel 10 is switched by circulating cooling water W to one of the first to fourth passages 11 to 14. The cooling water channel 10 is switched by causing a cooling circuit control unit 101 in an ECU 100 to control a cooling circuit switching unit 6. The cooling circuit switching unit 6 includes a thermostat valve 6*a*, a first control valve 6*b*, a second control valve 6*c*, and a third control valve 6*d*. In the following, the first to fourth passages 11 to 14 are described in detail.

The first passage 11 communicates between the head-side discharge hole 62 and the inlet hole 36. The first passage 11 bypasses the radiator 7, and successively passes a water temperature sensor 102 for detecting a temperature of cooling water W, and the thermostat valve 6*a* in this order. The thermostat valve 6*a* is a valve configured to open when the first to third control valves 6*b* to 6*d* are out of order, and the temperature of cooling water W exceeds a predetermined value. The thermostat valve 6*a* is configured such that in an ordinary state, cooling water W is allowed to circulate only through the first passage 11, and in an anomalous state, cooling water W is allowed to circulate through the second passage 12 as well as through the first passage 11 for protecting the engine 2. The water temperature sensor 102 is disposed near the head-side discharge hole 62.

The second passage 12 communicates between the head-side discharge hole 62 and the inlet hole 36. The second passage 12 bypasses the radiator 7, and successively passes an idling stop water pump (WP) 21, an air conditioning heater core 22, an EGR cooler (EGR/C) 23, an EGR valve (EGR/V) 24, and the first control valve 6*b* in this order. The idling stop water pump 21 is a pump configured to flow cooling water W to the air conditioning heater core 22 when the engine 2 is temporarily stopped during an idling operation. The EGR cooler 23 and the EGR valve 24 are disposed side by side in the second passage 12.

The third passage 13 communicates between the block-side discharge hole 37 and the inlet hole 36. The third passage 13 bypasses the radiator 7, and successively passes an engine oil cooler (O/C) 25, an oil heat exchanger (ATF/W) 26 for automatic transmission, and the second control valve 6*c* in this order. The engine oil cooler 25 is disposed in the block-side discharge hole 37.

The fourth passage 14 communicates between the header-side discharge hole 62 and the inlet hole 36. The fourth passage 14 passes the water temperature sensor 102, the radiator 7, and the third control valve 6*d* in this order.

The cooling circuit control unit 101 is one of the control units provided in the ECU 100. The cooling circuit control unit 101 is configured to receive a detection signal form the water temperature sensor 102, the engine rotation number sensor 103, and the fuel injection amount sensor 104, estimates a head combustion chamber wall surface temperature of the engine 2 i.e. a head temperature T, based on a load state of the engine 2 to be determined by the engine rotation number and the fuel injection amount for controlling the first to third control valves 6*b* to 6*d* in accordance with the estimated head temperature T. This will be described later (see FIG. 14 to FIG. 15D).

Figure 2:
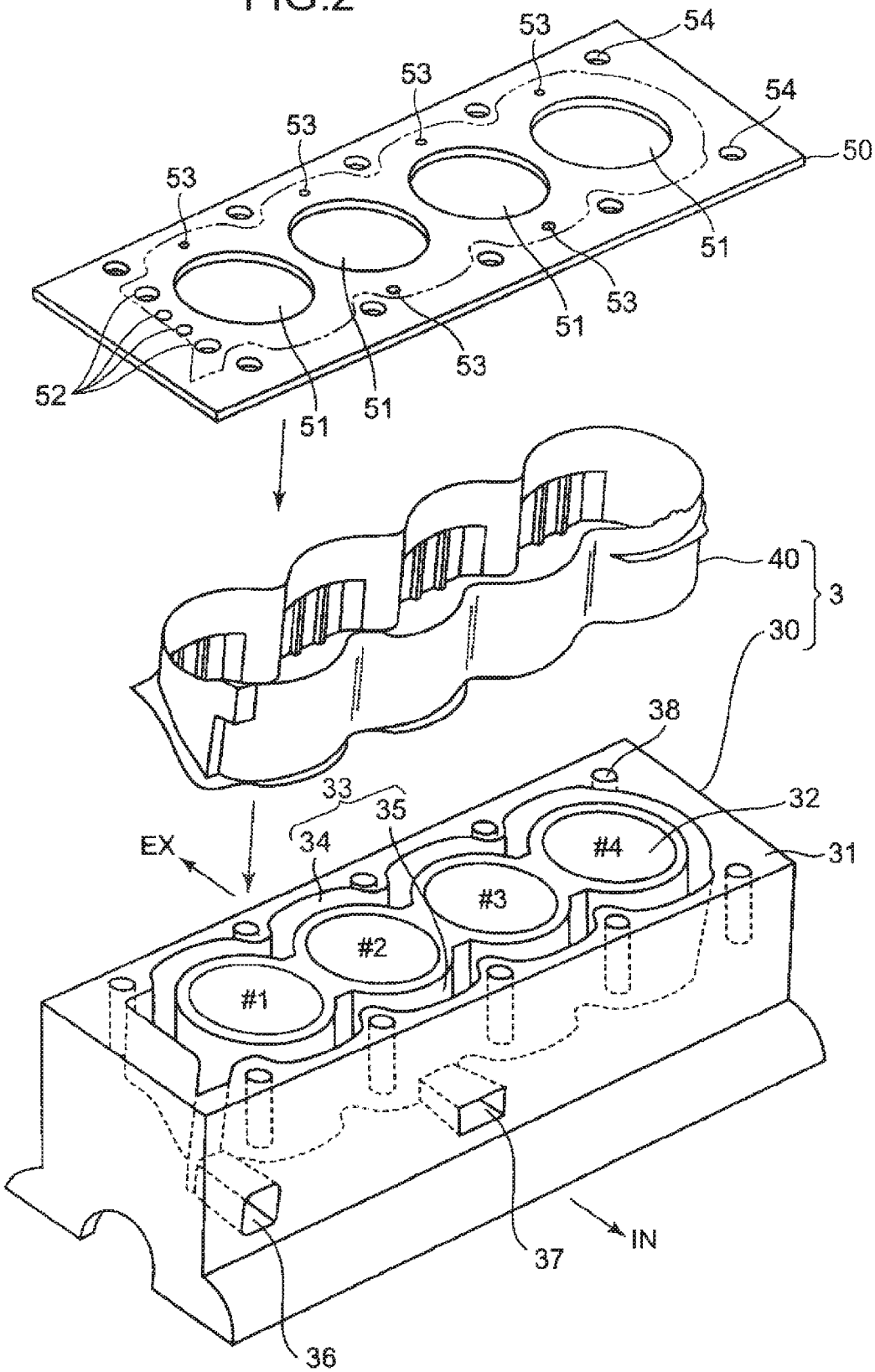
FIG. 2 is an exploded perspective view of a cylinder block of the cooling device.
Figure 3:
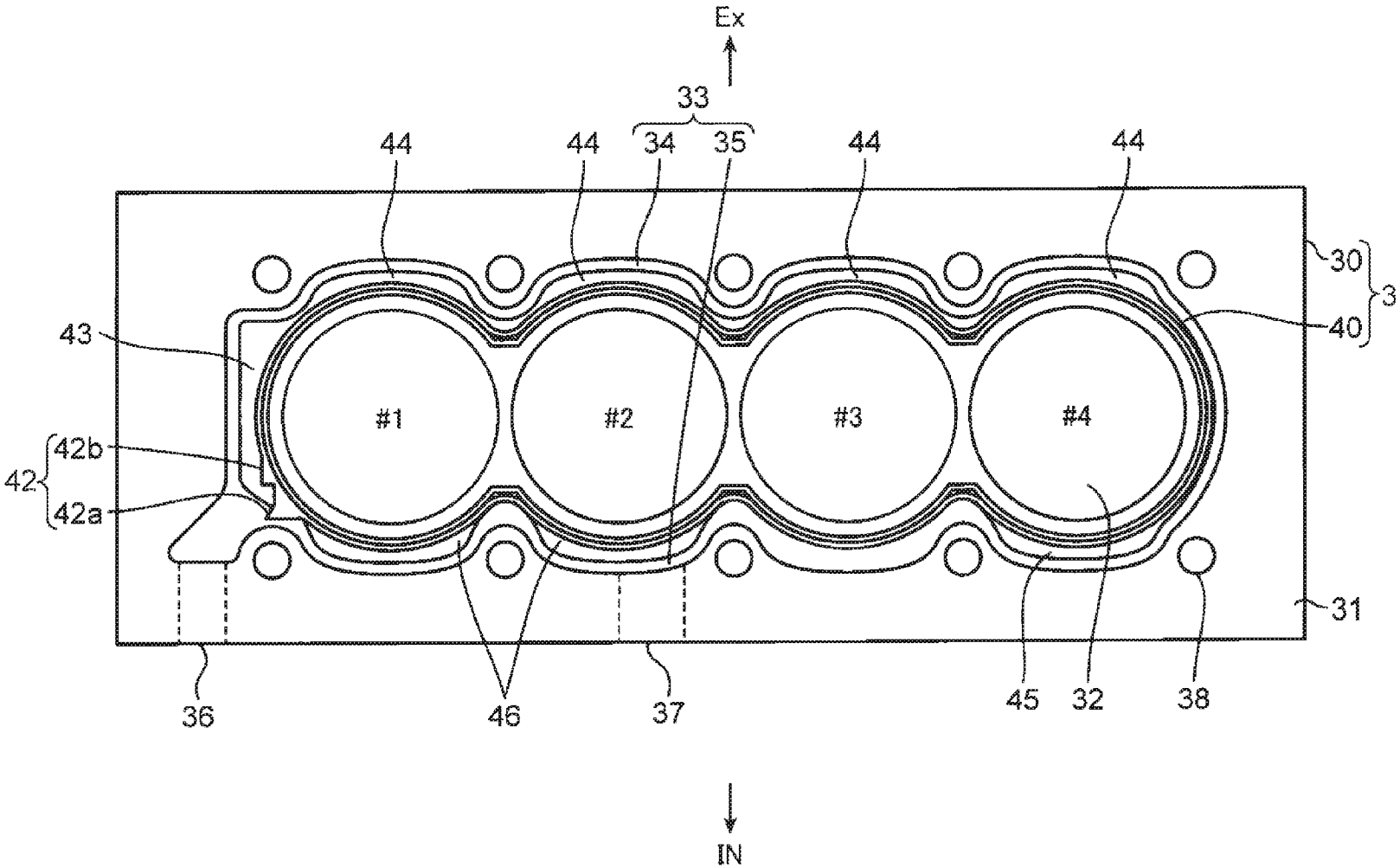
FIG. 3 is a plan view of the cylinder block.

FIG. 2 is an exploded perspective view of the cylinder block 3. FIG. 3 is a plan view of the cylinder block 3. The cylinder block 3 includes, as main constituent elements, a cylinder block main body 30, and a spacer 40. Although a gasket 50 is not an essential constituent element of the cylinder block 3, to simplify the description, the gasket 50 is also illustrated in FIG. 2.

The cylinder block main body 30 is configured such that cylinder axes of cylinder bores 32 of first to fourth cylinders #1 to #4 disposed in series extend in up and down directions. As illustrated in FIG. 2 and FIG. 3, the block-side water jacket 33, which is an annular recess groove surrounding the four cylinder bores 32, is formed in an upper surface 31 of the cylinder block main body 30. The block-side water jacket 33 includes an exhaust-side channel 34 passing through an exhaust side portion of the cylinder block 3, and an intake-side channel 35 passing through the intake side portion of the cylinder block 3.

In the embodiment, the first to fourth cylinders #1 to #4 are aligned in this order from left to right, when the cylinder block 3 is viewed from the intake side. In the embodiment, in the cylinder array of the first to fourth cylinders #1 to #4, the side of the cylinder array where the first cylinder #1 is disposed is called as "one end side", and the side of the cylinder array where the fourth cylinder #4 is disposed is called as "the other end side".

Figure 4:
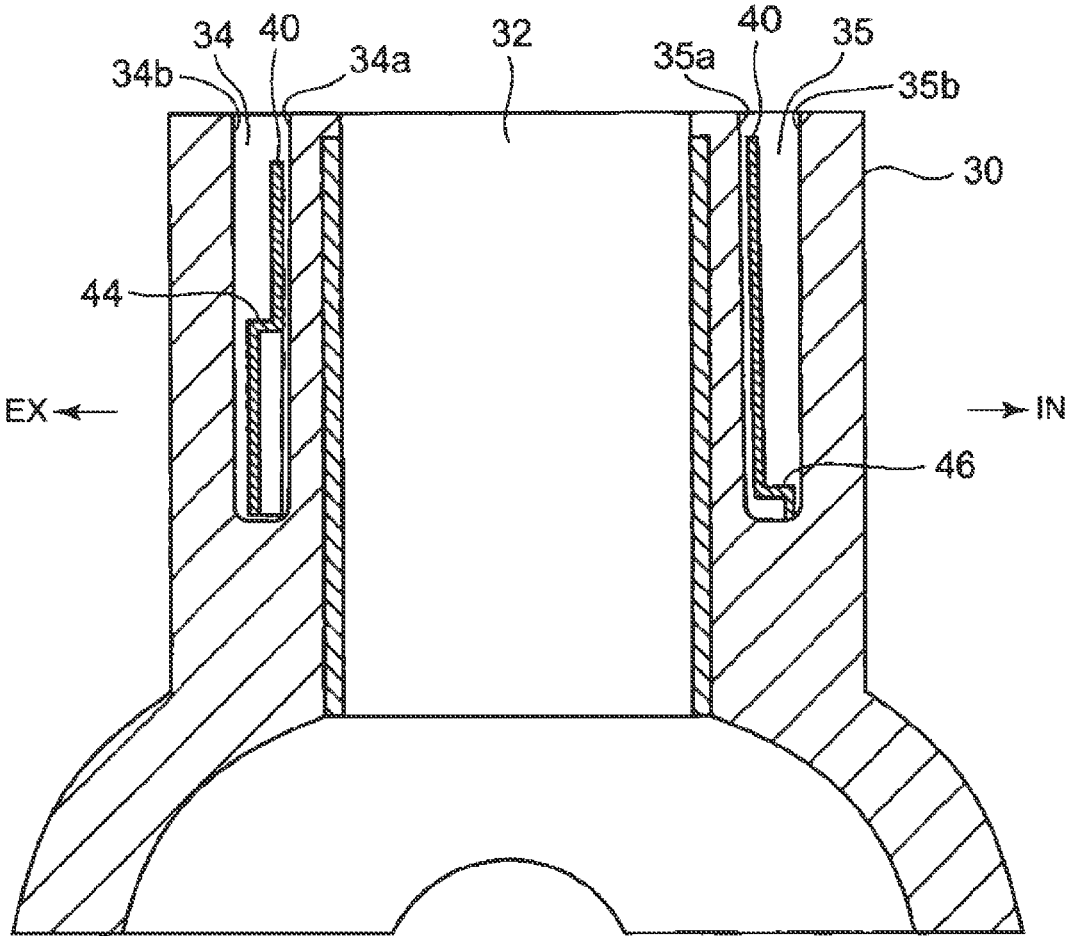
FIG. 4 is a longitudinal sectional view of the second cylinder of the cylinder block.
Figure 5:
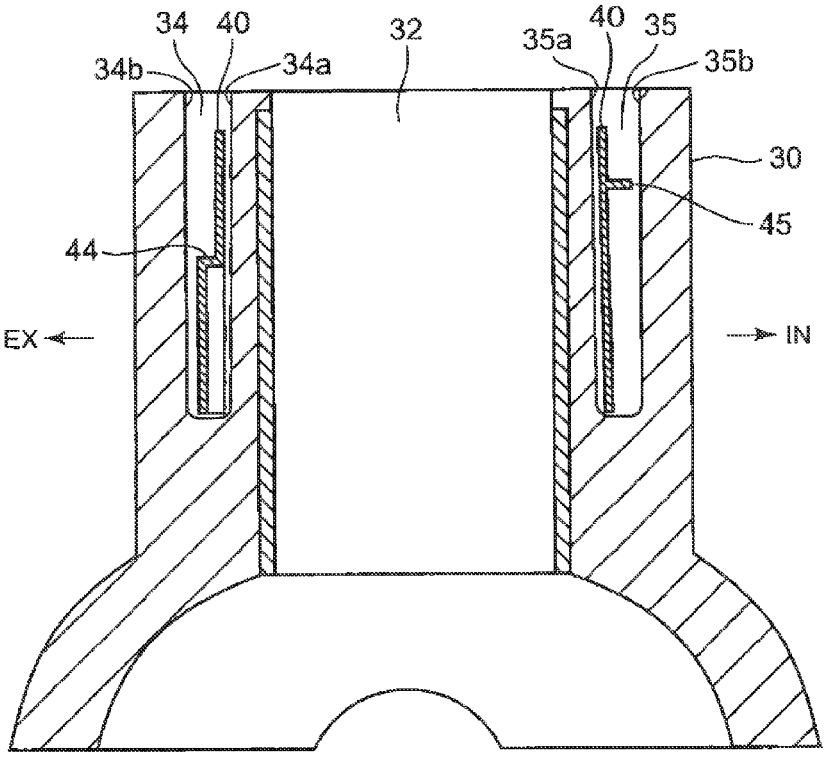
FIG. 5 is a longitudinal sectional view of the fourth cylinder of the cylinder block.

Further, in the embodiment, among the wall surfaces constituting the exhaust-side channel 34 and the intake-side channel 35 of the block-side water jacket 33, which is a recess groove, the inner side walls are called as inner wall portions 34*a* and 35*a*, and the outer side walls are called as outer wall portions 34*b* and 35*b* (see FIG. 4 and FIG. 5).

The cylinder block main body 30 includes the inlet hole (inlet portion) 36, which is formed on one end side of the cylinder array, and configured to introduce cooling water W to the block-side water jacket 33; and the block-side discharge hole (block-side discharge portion) 37, which is formed in the intake side portion of the cylinder block main body 30 at the middle of the cylinder array, and configured to discharge cooling water W from the block-side water jacket 33.

Further, the cylinder block main body 30 includes screw holes 38 . . . 38, which are engagable with head bolts (not illustrated) for engagement between the cylinder block 3 and the cylinder head 4 via the gasket 50.

The gasket 50 is a metal sheet gasket formed by placing metal plates one over another into one sheet by caulking at several positions. The overall shape of the gasket 50 is substantially the same as the upper surface 31 of the cylinder block main body 30.

As illustrated in FIG. 2, circular holes 51 . . . 51 are formed in the gasket 50 at the positions corresponding to the cylinder bores 32 of the cylinder block main body 30. Insertion holes 54 . . . 54 for the head bolts described above are formed in the gasket 50 at the positions corresponding to the screw holes 38 . . . 38.

Further, the gasket 50 includes first communication holes (communication paths) 52 . . . 52 and second communication holes 53 . . . 53 for communicating between the block-side water jacket 33 and the head-side water jacket 61 (see FIG. 1). The first communication holes 52 . . . 52 are formed in the gasket 50 on one end side of the cylinder array. The second communication holes 53 . . . 53 are formed in the exhaust side portion and in the intake side portion of the gasket 50, respectively.

When the cylinder block 3 and the cylinder head 4 are connected to each other via the gasket 50, the peripheries of the circular holes 51 . . . 51 and the peripheries of the insertion holes 54 . . . 54 are sealed by an elastic resilient force of the gasket 50. This makes it possible to prevent leakage of combustion gas from the combustion chamber of each of the cylinders #1 to #4, and prevent leakage of cooling water W from the block-side water jacket 33 and from the head-side water jacket 61.

As illustrated in FIG. 1, the cylinder head 4 includes a head-side discharge hole 62 through which cooling water W is discharged from the head-side water jacket 61 to the other end side of the cylinder array.

FIG. 4 is a longitudinal sectional view of the second cylinder #2 of the cylinder block 3. FIG. 5 is a longitudinal sectional view of the fourth cylinder #4 of the cylinder block 3.

As illustrated in FIG. 4 and FIG. 5, the spacer 40 is disposed inside the block-side water jacket 33. The spacer 40 is configured such that a bottom portion of the spacer 40 is placed in contact with the bottom surface of the block-side water jacket 33, and a gap is formed between the spacer 40 and each of the inner wall portions 34*a* and 35*a* of the block-side water jacket 33, and between the spacer 40 and each of the outer wall portions 34*b* and 35*b* of the block-side water jacket 33.

The spacer 40 is formed in such a manner that the gap between the inner surface of the spacer 40 and each of the inner wall portions 34*a* and 35*a* of the block-side water jacket 33 is relatively small, and the gap between the outer surface of the spacer 40 and each of the outer wall portions 34*b* and 35*b* of the block-side water jacket 33 is relatively large. According to this configuration, the outer gaps of the spacer 40 serve as a main channel along which cooling water W is allowed to flow. When the channel is simply called as the "exhaust-side channel 34" or the "intake-side channel 35", the channel indicates the outer gap of the spacer 40.

As illustrated in FIG. 4 and FIG. 5, the exhaust-side channel 34 of the block-side water jacket 33 is configured such that the upper portion of the exhaust-side channel 34 in the cylinder axis direction has a large sectional area as compared with the lower portion thereof, because the gap between the spacer 40 and the outer wall portion 34*b* is large in the upper portion of the channel with respect to a step portion 44 of the spacer 40 to be described later, as compared with the lower portion thereof.

Figure 6:
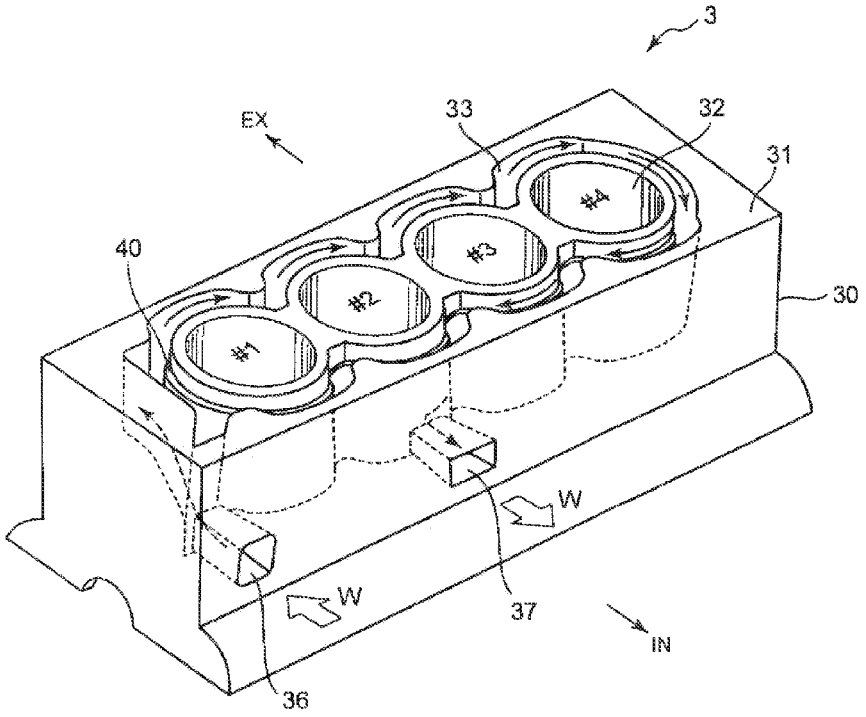
FIG. 6 is a perspective view of the cylinder block.
Figure 7:
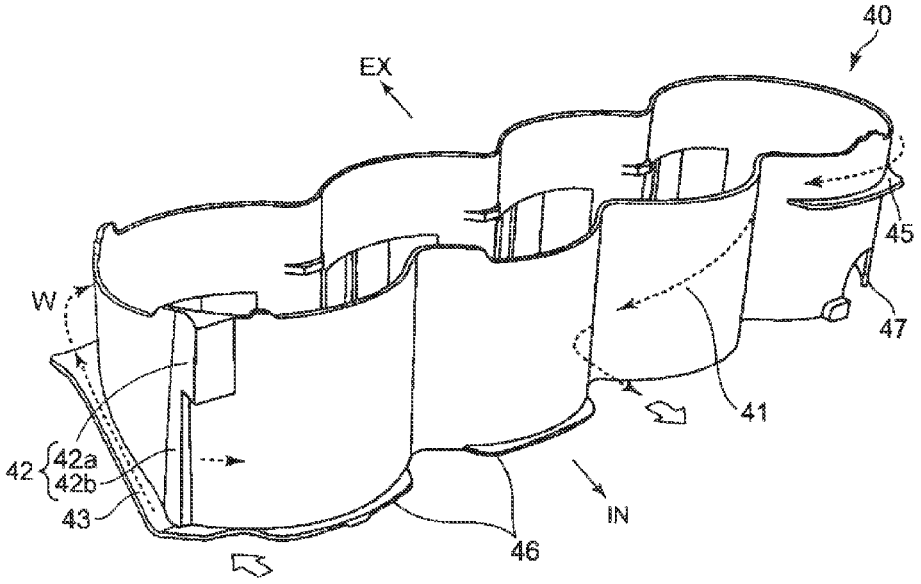
FIG. 7 is a perspective view of an intake side of a spacer.
Figure 8:
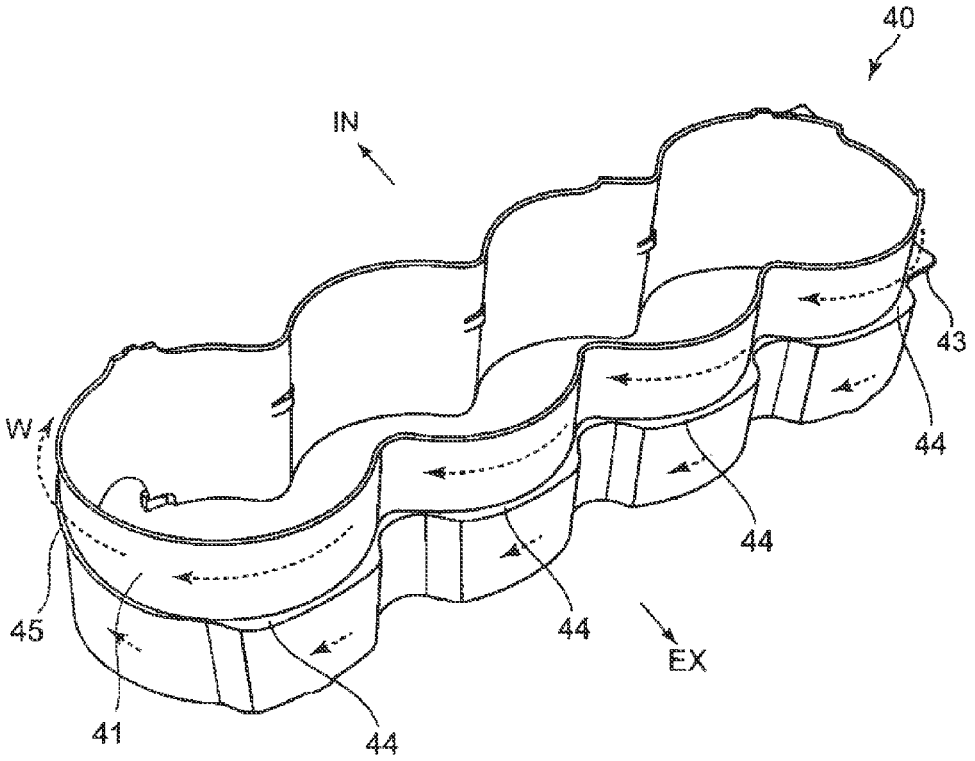
FIG. 8 is a perspective view of an exhaust side of the spacer.
Figure 9:
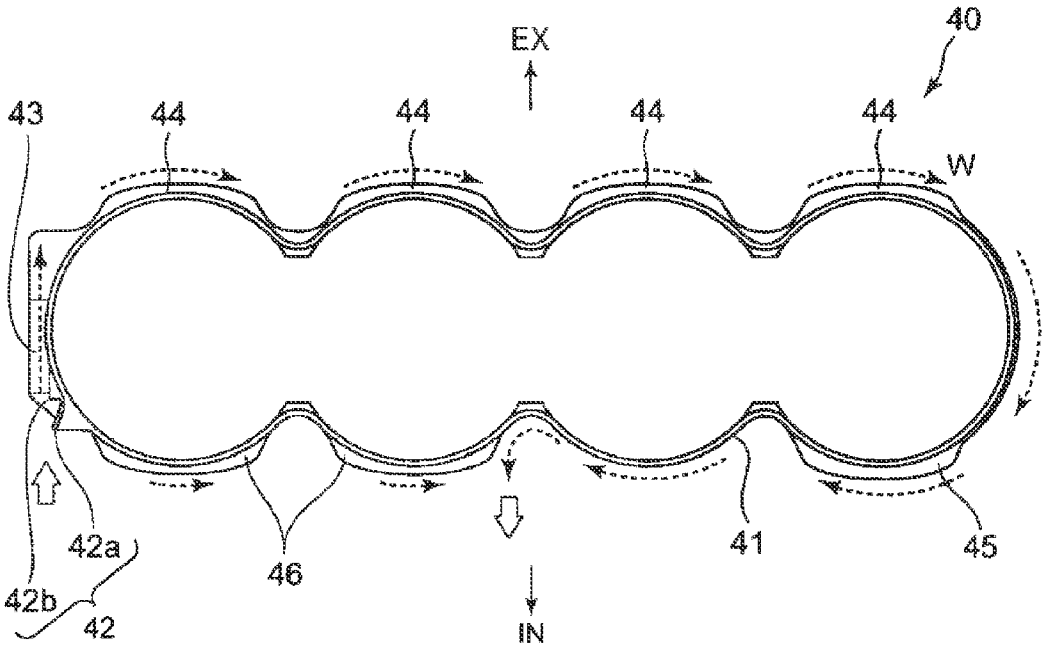
FIG. 9 is a plan view of the spacer.
Figure 10:
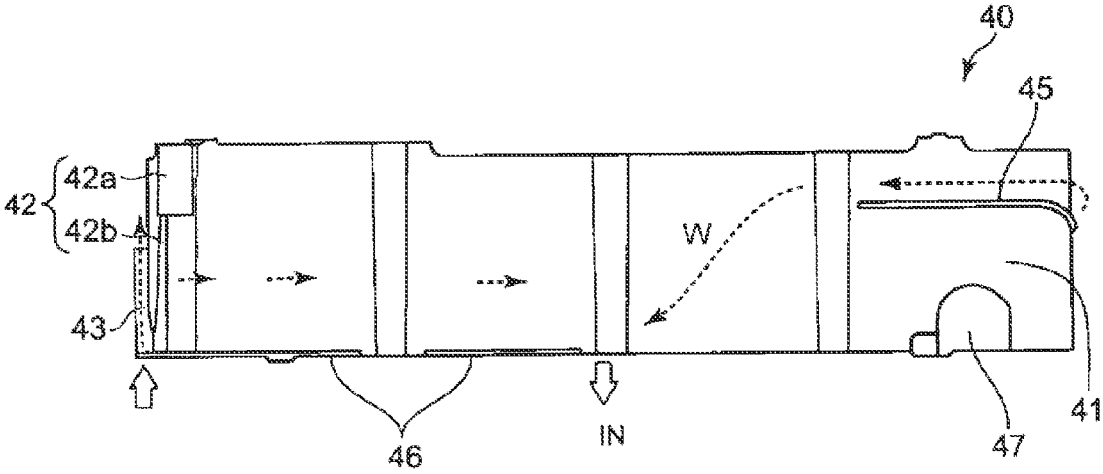
FIG. 10 is a front view of the intake side of the spacer.
Figure 11:
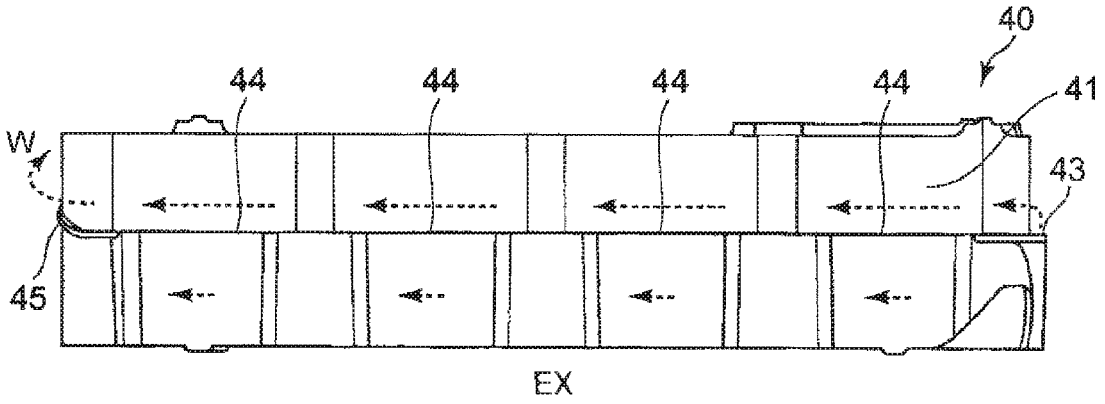
FIG. 11 is a rear view of the exhaust side of the spacer.
Figure 12:
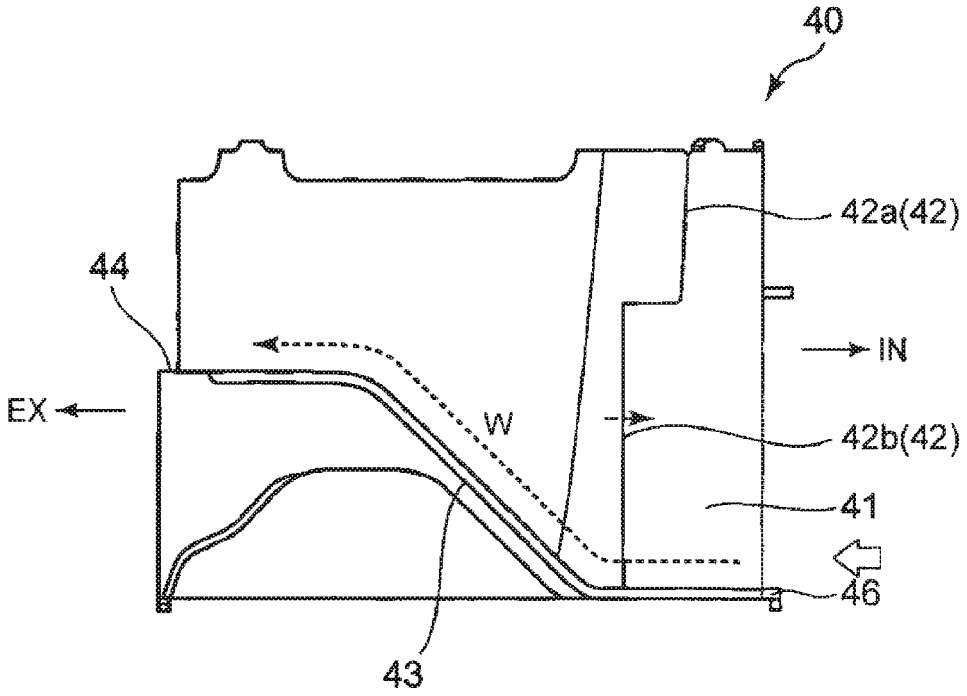
FIG. 12 is a side view of an inclined portion side (one end side) of the spacer.
Figure 13:
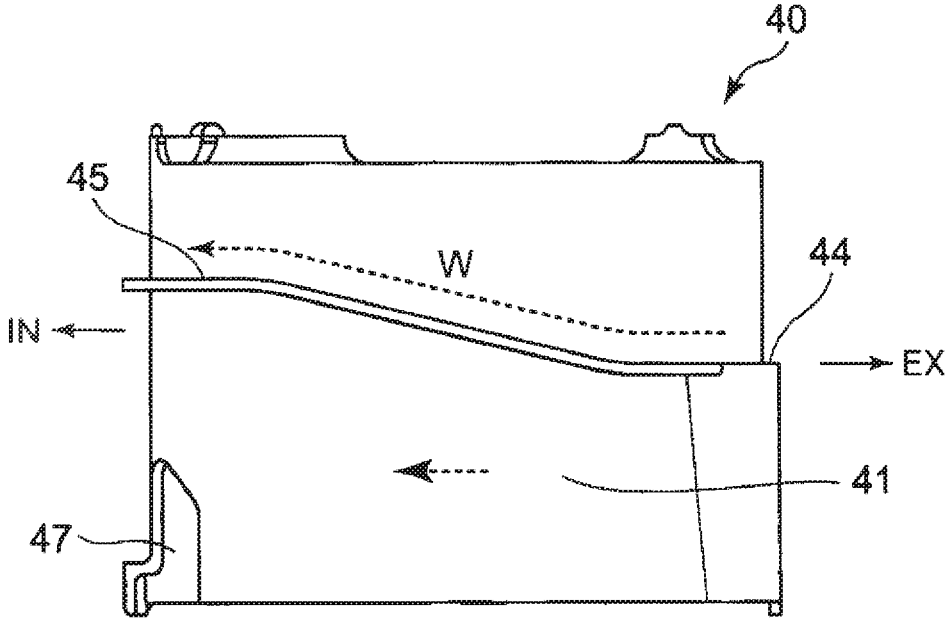
FIG. 13 is a side view of a guide portion side (other end side) of the spacer.

Next, a structure of the spacer 40 is described referring to FIG. 6 to FIG. 13. FIG. 6 is a perspective view of the cylinder block 3. FIG. 7 is a perspective view of the spacer 40 alone, when viewed from the intake side. FIG. 8 is a perspective view of the spacer 40 alone, when viewed from the exhaust side. FIG. 9 is a plan view of the spacer 40 alone, when viewed from above. FIG. 10 is a front view of the spacer 40 alone, when viewed from the intake side. FIG. 11 is a rear view of the spacer 40 alone, when viewed from the exhaust side. FIG. 12 is a side view of the spacer 40 alone, when viewed from one end side of the cylinder array. FIG. 13 is a side view of the spacer 40 alone, when viewed from the other end side of the cylinder array. In these drawings, the symbols IN (intake side) and EX (exhaust side) indicating the directions when the spacer 40 is disposed inside the block-side water jacket 33 are illustrated.

As illustrated in FIG. 6, the spacer 40 has a thickness such that the spacer 40 is accommodated in the block-side water jacket 33 with a gap, and a height such that the spacer 40 does not project from the upper surface 31 of the cylinder block 33 (see FIG. 4 and FIG. 5). As illustrated in FIG. 7 to FIG. 13, the spacer 40 is mainly constituted of an annular vertical wall portion 41 in plan view extending substantially in parallel to the cylinder axis direction.

For instance, as illustrated in FIG. 7, FIG. 9, FIG. 10, and FIG. 12, a rib-like narrow portion 42 projecting outward from the outer periphery of the vertical wall portion 41 is formed on the intake side portion of the vertical wall portion 41 on one end side of the cylinder array (see FIG. 3). The narrow portion 42 includes an upper narrow portion 42*a* and a lower narrow portion 42*b*. The narrow portion 42 is formed such that the projection amount of the upper narrow portion 42*a* is larger than the projection amount of the lower narrow portion 42*b*.

For instance, as illustrated in FIG. 7, FIG. 9, FIG. 10, and FIG. 12, the vertical wall portion 41 on one end side of the cylinder array includes a rib-like inclined portion 43 configured such that the inclined portion 43 is smoothly inclined from the intake side toward the exhaust side while climbing from the lower end of the vertical wall portion 41 up to the middle of the vertical wall portion 41 in the cylinder axis direction (see FIG. 3).

For instance, as illustrated in FIG. 8, FIG. 9, and FIG. 11 to FIG. 13, the exhaust side portion of the vertical wall portion 41 includes the step portion 44 continuing to the upper end of the inclined portion 43 at the middle of the vertical wall portion 41 in the cylinder axis direction (see FIG. 3 to FIG. 5). According to this configuration, when the spacer 40 is disposed inside the block-side water jacket 33, the gap between the spacer 40 and the outer wall portion 34*b* is large in the upper portion of the exhaust-side channel 34 with respect to the step portion 44, as compared with the lower portion thereof.

For instance, as illustrated in FIG. 7 to FIG. 11, and FIG. 13, the vertical wall portion 41 on the other end side of the cylinder array includes a rib-like guide portion 45, which continues to the step portion 44, extends from the exhaust side portion of the vertical wall portion 41 to the intake side portion thereof, and is smoothly inclined from the exhaust side toward the intake side while climbing farther toward the cylinder head 4 (see FIG. 3 and FIG. 5).

For instance, as illustrated in FIG. 7, FIG. 9, FIG. 10, and FIG. 12, a brim portion 46 projecting outward from the outer periphery of the vertical wall portion 41 is formed at the lower end of the intake side portion of the vertical wall portion 41 (see FIG. 3 and FIG. 4).

For instance, as illustrated in FIG. 7, FIG. 10, and FIG. 13, a heater insertion portion 47, which is a cutaway for receiving a heater for a cold district (not illustrated), is formed in the lower end of the intake side portion of the vertical wall portion 41 on the other end side of the cylinder array.

The spacer 40 is disposed inside the block-side water jacket 33. In view of the above, the spacer 40 is made of resin having a heat resistance capable of withstanding a high temperature condition inside the cylinder block 3 and having a rigidity capable of preventing deformation or damage by a water pressure of cooling water W. Examples of the resin are polyamide-based thermoplastic resin such as PA66 or PPA, olefin-based thermoplastic resin such as PP, and polyphenylene sulfide-based thermoplastic resin such as PPS. It is possible to use one kind of these materials alone or two or more kinds thereof in combination. Glass fibers may be blended with the resin, as necessary. The resin-made spacer 40 can be integrally formed by e.g. an injection molding machine.

Next, operations of the spacer 40 are described referring to FIG. 6 to FIG. 13. In these drawings, arrows indicating the flows of cooling water W when the spacer 40 is disposed inside the block-side water jacket 33 are illustrated.

(1) First of all, cooling water W is introduced to the inside of the block-side water jacket 33 through the inlet hole 36 of the cylinder block 3 by the water pump 5.

As described above, the spacer 40 is disposed inside the block-side water jacket 33, with a gap being formed between the spacer 40 and each of the inner wall portions 34*a* and 35*a*, and between the spacer 40 and each of the outer wall portions 34*b* and 35*b* (see FIG. 3 to FIG. 5). According to this configuration, it is possible to restrict local lowering of the temperature of the cylinders resulting from direct contact of cooling water W introduced through the inlet hole 36 with the inner wall portions 34*a* and 35*a* of the block-side water jacket 33.

Further, as illustrated in FIG. 7, a flow of cooling water W introduced through the inlet hole 36 to the intake-side channel 35 is restricted by the narrow portion 42 formed on the intake side in the vicinity of the inlet hole 36. Therefore, a main part of cooling water W is allowed to flow to the exhaust-side channel 34. On the other hand, the projection amount of the lower narrow portion 42*b* is smaller than the projection amount of the upper narrow portion 42*a*. This allows for cooling water W of a relatively small amount that has flowed through a wider gap between the lower narrow portion 42*b* and the outer wall portion 35*b* to flow to the intake-side channel 35.

According to the aforementioned configuration, a larger amount of cooling water W is allowed to flow to the exhaust-side channel 34, as compared with the intake-side channel 35. This is advantageous in cooling the exhaust side portion of the cylinder block 3, where the temperature is likely to increase, as compared with the intake side portion of the cylinder block 3, and in reducing a temperature difference between the intake side portion and the exhaust side portion of each cylinder.

(2) Subsequently, as illustrated in FIG. 6, FIG. 7, and FIG. 12, cooling water W that has flowed to the exhaust-side channel 34 is allowed to flow toward the cylinder head 4 while being guided by the inclined portion 43 formed on the exhaust side in the vicinity of the inlet hole 36.

The block-side water jacket 33 and the head-side water jacket 61 are communicated with each other via the first communication holes 52, which are formed in one end of the gasket 50. According to this configuration, as will be described later, when the cooling circuit control unit 101 controls to circulate cooling water W only through the first passage 11 when the engine 2 is in a cold state, cooling water W guided toward the cylinder head 4 is less likely to flow through the exhaust-side channel 34 of the block-side water jacket 33, and is easy to flow into the head-side water jacket 61 through the first communication holes 52.

According to the aforementioned configuration, when the engine 2 is in a cold state, warming up of the engine 2 is accelerated by gradual increase of the temperature of the cylinder block 3 without cooling of the cylinder block 3. In addition to the above, even when the engine 2 is in a cold state, the cylinder head 4 exposed to high-temperature exhaust gas is cooled. Cooling water W that has flowed through the head-side water jacket 61 is discharged through the head-side discharge hole 62 formed in the other end of the cylinder head 4.

(3) Subsequently, as illustrated in FIG. 8 and FIG. 11, cooling water W is allowed to flow from the inclined portion 43 to the exhaust-side channel 34 in such a manner that a large amount of cooling water W is allowed to flow in the upper portion of the channel with respect to the step portion 44 continuing to the upper end of the inclined portion 43, and a small amount of cooling water W is allowed to flow in the lower portion of the channel. This is because due to the existence of the step portion 44, the gap between the spacer 40 and the outer wall portion 34*b* is large in the upper portion of the channel with respect to the step portion 44, as compared with the lower portion of the channel, and the sectional area of the channel is large in the upper portion, as compared with the lower portion.

According to the aforementioned configuration, it is possible to advantageously cool the exhaust-side upper portion of the cylinder block 3 where the temperature is particularly likely to increase by high-temperature exhaust gas, as compared with the exhaust-side lower portion, when the engine 2 is actually operated (in other words, after the engine 2 is warmed up). This is advantageous in reducing a temperature difference between the upper portion and the lower portion of each cylinder.

(4) Subsequently, cooling water W that has flowed through the exhaust-side channel 34 is guided toward the cylinder head 4, as the cooling water W flows from the exhaust-side channel 34 toward the intake-side channel 35 while making a U-turn by the guide portion 45 continuing from the step portion 44 and formed on the other end of the vertical wall portion 41.

Therefore, cooling water W guided toward the cylinder head 4 is easy to flow into the head-side water jacket 61 via the second communication holes 53 formed in the intake side portion of the gasket 50. This is advantageous in cooling the cylinder head 4.

(5) Subsequently, cooling water W that did not flow into the head-side water jacket 61 via the second communication holes 53 passes through the intake-side channel 35, and is discharged through the block-side discharge hole 37 formed in the intake side portion of the cylinder block 3 at the middle of the cylinder array.

When cooling water W is allowed to flow from the inlet hole 36 to the block-side discharge hole 37 as described above, the temperature of the cooling water W is gradually increased, while absorbing heat from each cylinder. Therefore, for instance, whereas cooling of the exhaust side portion of the first cylinder #1 is accelerated by cooling water W of a relatively low temperature, cooling of the intake side portion of the first cylinder #1 is not accelerated, because cooling water W hardly flows due to the existence of the narrow portion 42. On the other hand, both of the exhaust side portion and the intake side portion of the fourth cylinder #4 are cooled by cooling water W of a relatively high temperature.

Therefore, when cooling is compared between the exhaust side portion and the intake side portion of each cylinder by temperature averaging, the first cylinder #1 and the fourth cylinder #4 at both ends of the cylinder array are substantially equally cooled. Thus, it is possible to reduce a temperature difference between the cylinders.

As described above, reducing a temperature difference between the intake side portion and the exhaust side portion of each cylinder, a temperature difference between the upper portion and the lower portion of each cylinder, and a temperature difference between the cylinders makes it possible to make a temperature distribution of the entirety of the cylinders uniform.

(6) As described above, the brim portion 46 projecting outward from the outer periphery of the spacer 40 is formed on the lower end of the intake side portion of the vertical wall portion 41 (see FIG. 4). Therefore, forming the brim portion 46 makes it possible to restrict cooling water W flowing to the intake-side channel 35 through the gap between the lower narrow portion 42*b* and the outer wall portion 35*b* from intruding to the inside of the spacer 40 (a gap between the inner surface of the spacer 40 and the inner wall portion 35*a*) from the lower end of the spacer 40. This is advantageous in preventing a temperature difference between the upper portion and the lower portion of each cylinder.

(7) The heater insertion portion 47 for a cold district is formed in the vertical wall portion 41 of the spacer 40. Placing a heater for a cold district in the heater insertion portion 47 for a cold district makes it possible to prevent freezing of cooling water W inside the block-side water jacket 33.

(8) The narrow portion 42, the inclined portion 43, the step portion 44, the guide portion 45, and the brim portion 46 are formed on the outer periphery of the vertical wall portion 41 of the spacer 40. This makes it easy to integrally form the narrow portion 42, the inclined portion 43, the step portion 44, the guide portion 45, and the brim portion 46 with the spacer 40.

Figure 14:
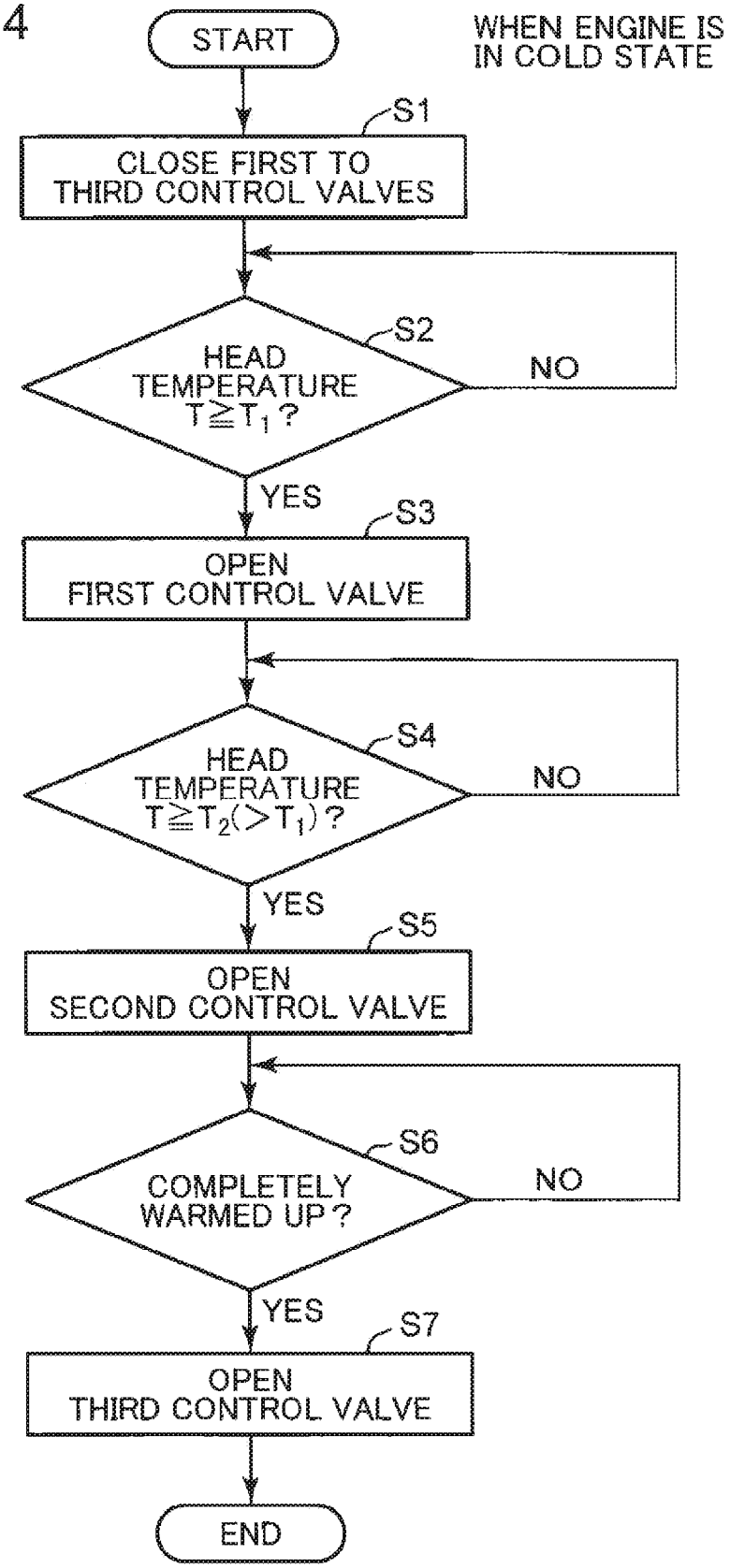
FIG. 14 is a flowchart illustrating a control method to be performed by a cooling circuit control unit of the cooling device.

FIG. 14 is a flowchart illustrating a control method to be performed by the cooling circuit control unit 101. FIGS. 15A to 15D are block diagrams illustrating an engine-temperature based cooling method. Next, a control method of the cooling device 1 to be performed by the cooling circuit control unit 101 in accordance with the flowchart of FIG. 14 is described referring to FIGS. 15A to 15D.

Figure 15A:
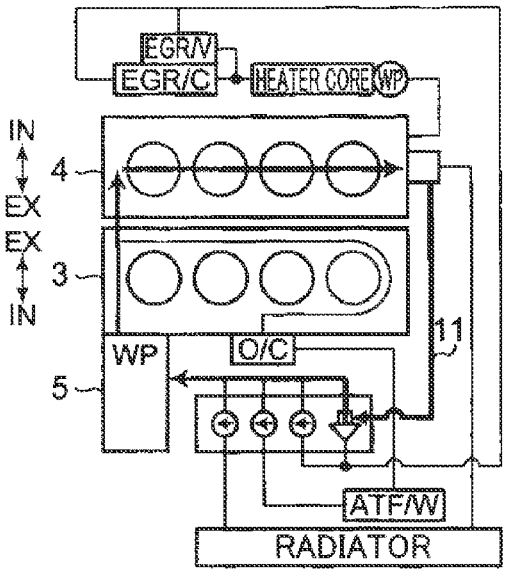
FIGS. 15A to 15D are block diagrams illustrating an engine-temperature-based cooling method to be performed by the cooling device.

First of all, when the engine 2 is in a cold state, the cooling circuit control unit 101 closes all the control valves 6*b* to 6*d* (Step S1). When the above operation is performed, as illustrated in FIG. 15A, cooling water W is circulated only through the first passage 11. Cooling water of a relatively small amount is allowed to flow to the cylinder head 4 in order to warm up the engine 2, while preventing local heating of the engine 2.

Subsequently, the cooling circuit control unit 101 determines whether the head temperature T (as described above, the head combustion chamber wall surface temperature of the engine 2 to be estimated based on a load state of the engine 2 to be determined by the engine rotation number and the fuel injection amount) is equal to or higher than a predetermined temperature $T_1$ (e.g. 150° C.) (Step S2).

Figure 15B:
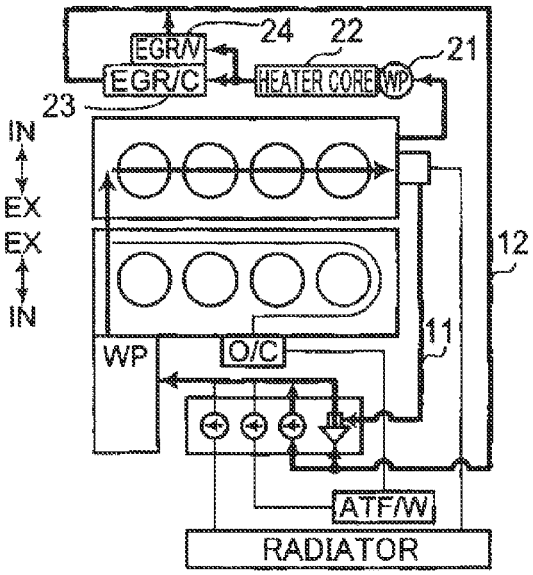

When it is determined that the head temperature T is equal to or higher than the predetermined temperature $T_1$ in Step S2, the cooling circuit control unit 101 opens the first control valve 6*b* (Step S3). As illustrated in FIG. 15B, when the above operation is performed, cooling water W is circulated through the first passage 11 and the second passage 12.

Subsequently, the cooling circuit control unit 101 determines whether the head temperature T is equal to or higher than a predetermined temperature $T_2$ ($T_2>T_1$), which is higher than the temperature $T_1$ (Step S4).

Figure 15C:
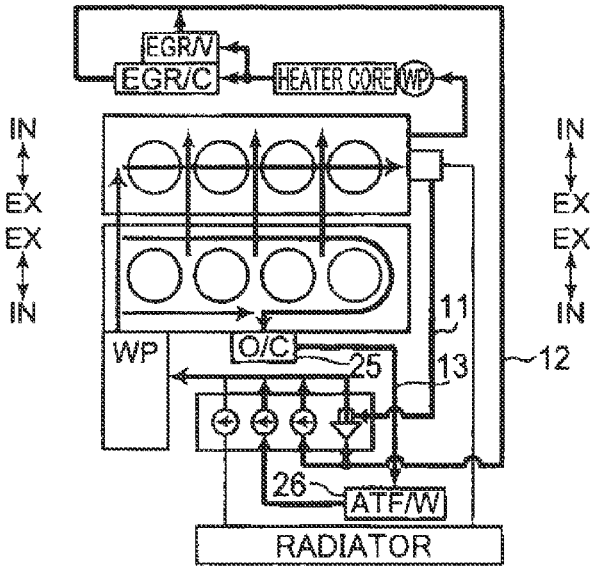

When it is determined that the head temperature T is equal to or higher than the predetermined temperature $T_2$ in Step S4, the cooling circuit control unit 101 opens the second control valve 6*c* (Step S5). As illustrated in FIG. 15C, when the above operation is performed, cooling water W is circulated through the first passage 11 to the third passage 13.

Subsequently, the cooling circuit control unit 101 determines whether the engine 2 is completely warmed up, in other words, whether warming up of the engine 2 is completed (Step S6). This determination may be a determination as to whether the head temperature T is equal to or higher than a predetermined temperature $T_3$ ($T_3>T_2$), which is higher than the temperature $T_2$.

Figure 15D:
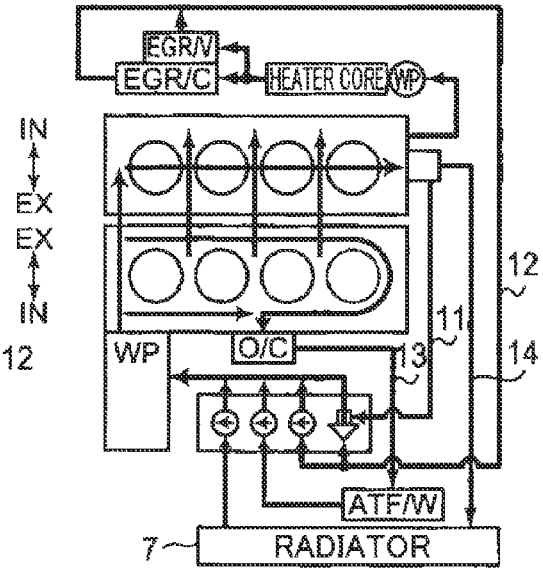

When it is determined that the engine 2 is completely warmed up in Step S6, the cooling circuit control unit 101 opens the third control valve 6*d* (Step S7). As illustrated in FIG. 15D, when the above operation is performed, cooling water W is circulated all through the first passage 11 to the fourth passage 14.

As described above, when the first to third control valves 6*b* to 6*d* are closed by the cooling circuit control unit 101 in a state that the engine 2 is operated in a cold state, cooling water W is circulated only through the first passage 11 communicating between the head-side discharge hole 62 and the inlet hole 36. When the above operation is performed, cooling water W hardly flows to the block-side water jacket 33. Therefore, the temperature of the cylinder block 3 is gradually increased, and warming up of the engine 2 is accelerated. On the other hand, cooling water W is allowed to flow to the head-side water jacket 61. Therefore, even when the engine 2 is operated in a cold state, cooling of the cylinder head 4 exposed to high-temperature exhaust gas is accelerated.

Subsequently, as the engine temperature is increased, the first to third control valves 6*b* to 6*d* are opened one after another by the cooling circuit control unit 101. First of all, when the first control valve 6*b* is opened, cooling water W is circulated through the second passage 12, as well as through the first passage 11. The second passage 12 does not pass the radiator 7, and cooling water W hardly flows to the block-side water jacket 33. Therefore, warming up of the engine 2 is accelerated.

Subsequently, when the second control valve 6*c* is opened, cooling water W is circulated through the third passage 13, as well as through the first and second passages 11 and 12. The third passage 13 is connected to the cylinder block 3. Therefore, the cylinder block 3 is cooled to some extent. However, since the third passage 13 bypasses the radiator 7, warming up of the engine 2 is accelerated.

Lastly, when the third control valve 6*d* is opened, cooling water W is circulated through the fourth passage 14, as well as through the first to third passages 11 to 13. The fourth passage 14 is connected to the radiator 7. Therefore, the temperature of cooling water W is lowered by the radiator 7.

Thus, it is possible to keep the temperature of the engine 2 after a warming-up operation to a predetermined temperature.

According to the control method of the cooling device 1 to be performed by the cooling circuit control unit 101, closing the first to third control valves 6*b* to 6*d* when the engine 2 is operated in a cold state, and opening the first to third control valves 6*b* to 6*d* one after another as the engine temperature is increased makes it possible to appropriately cool the cylinders and the cylinder head 4 in accordance with the temperature of the engine 2.

Further, in the course of a warming up operation, the first control valve 6*b* is opened to circulate cooling water W through the second passage 12 which passes the air conditioning heater core 22 and the EGR cooler 23, as well as through the first passage 11. This makes it possible to secure heating performance in the course of a warming up operation, and makes it possible to appropriately cool EGR gas by the EGR cooler 23.

Further, in the course of a warming up operation, the second control valve 6*c* is opened to circulate cooling water W through the third passage 13 which passes the engine oil cooler 25 and the oil heat exchanger 26 for automatic transmission, as well as through the first and second passages 11 and 12. This makes it possible to cool the engine oil in the course of a warming up operation, and makes it possible to appropriately heat the automatic transmission oil (ATF). This is advantageous in lowering the viscosity of transmission oil in an early stage, reducing the sliding resistance in an early stage, and enhancing the fuel consumption.

The following is a summary of the present invention as described above.

The present invention is directed to a cooling device 1 for a multi-cylinder engine 2 provided with a cylinder block 3 including a block-side water jacket 33 configured to surround a plurality of cylinder bores 32 for an array of cylinders #1 to #4 disposed in series; a cylinder head 4 including a head-side water jacket 61; and a cooling water channel 10 for circulating cooling water W by a water pump 5 via the block-side water jacket 33, the head-side water jacket 61, and a radiator 7.

The cylinder block 3 includes an inlet hole 36 formed on one end side of the cylinder array, and configured to introduce cooling water W to the block-side water jacket 33; a narrow portion 42 formed in the vicinity of the inlet hole 36, and configured to restrict the cooling water W introduced through the inlet hole 36 from flowing to an intake-side channel 35 of the block-side water jacket 33; and an inclined portion 43 formed in the vicinity of the inlet hole 36, and configured to guide the cooling water W introduced through the inlet hole 36 toward the cylinder head 4.

The cylinder head 4 includes a head-side discharge hole 62 formed on the other end side of the cylinder array, and configured to discharge the cooling water W from the head-side water jacket 61; and the first communication holes 52 . . . 52 formed on the cylinder head 4 side of the inclined portion 43, and configured to communicate between the block-side water jacket 33 and the head-side water jacket 61.

According to the aforementioned configuration, it is possible to control to circulate cooling water W only to the head-side water jacket 61 when the engine 2 is in a cold state. When the above operation is performed in a cold state of the engine 2, cooling water W guided toward the cylinder head 4 by the inclined portion 43 hardly flows to the exhaust-side channel 34 of the block-side water jacket 33, and is allowed to flow inside the head-side water jacket 61 via the first communication holes 52 . . . 52. This makes it possible to accelerate cooling of the cylinder head 4 that is exposed to high-temperature exhaust gas when the multi-cylinder engine 2 is in a cold state, and to accelerate warming up of the engine 2 by gradually increasing the engine temperature without cooling the cylinder block 3. This is advantageous in lowering the viscosity of lubricant oil (transmission oil) in an early stage, reducing the sliding resistance, and enhancing the fuel consumption.

In the invention, preferably, the cooling device may be further provided with a spacer 40 disposed in the block-side water jacket 33, with a gap being formed between the spacer 40 and each of inner wall portions 34*a* and 35*a* of the block-side water jacket 33, and between the spacer 40 and each of outer wall portions 34*b* and 35*b* of the block-side water jacket 33. The narrow portion 42 and the inclined portion 43 are formed on the outer periphery of the spacer 40.

According to the aforementioned configuration, it is possible to restrict direct cooling of the cylinders by cooling water W introduced through the inlet hole 36. Thus, it is possible to restrict local lowering of the engine temperature.

Further, it is easy to integrally form the spacer 40 with the narrow portion 42 and the inclined portion 43.

In the invention, preferably, an exhaust-side channel 34 of the block-side water jacket 33 may be formed in such a manner that a sectional area of an upper portion of the exhaust-side channel 34 in the cylinder axis direction is larger than a sectional area of a lower portion of the exhaust-side channel 34.

According to the aforementioned configuration, it is possible to advantageously cool the exhaust-side upper portion of the cylinder block 3 where the temperature is particularly likely to increase by high-temperature exhaust gas, as compared with the exhaust-side lower portion of the cylinder block 3, when the engine 2 is actually operated (after the engine 2 is warmed up). This is advantageous in reducing a temperature difference between an upper portion and a lower portion of each cylinder.

In the invention, preferably, a step portion 44 may be formed on the exhaust side portion of the spacer 40 at the middle of the spacer 40 in the cylinder axis direction, the step portion 44 continuing to the upper end of the inclined portion 43. The step portion 44 may be formed in such a manner that a gap between the spacer 40 and the outer wall portion 34*b* is large in an upper portion of the channel with respect to the step portion 44, as compared with a lower portion of the channel.

According to the aforementioned configuration, the exhaust side portion of the spacer 40 is configured such that the gap between the spacer 40 and the outer wall portion 34*b* is large in the upper portion of the channel in the cylinder axis direction, as compared with the lower portion of the channel. Therefore, it is possible to advantageously cool the exhaust-side upper portion of the cylinder block 3 where the temperature is particularly likely to increase by high-temperature exhaust gas, as compared with the exhaust-side lower portion of the cylinder block 3, when the engine 2 is actually operated (after the engine 2 is warmed up). This is advantageous in reducing a temperature difference between the upper portion and the lower portion of each cylinder.

In the invention, preferably, the narrow portion 42 may include a rib-like upper narrow portion 42*a* and a rib-like lower narrow portion 42*b*, each of which projects outward from the outer periphery of the spacer 40. The upper narrow portion 42*a* may be formed to have a larger projection amount than the lower narrow portion 42*b*.

According to the aforementioned configuration, a main part of cooling water W introduced through the inlet hole 36 is allowed to flow to the exhaust-side channel 34, and cooling water W of a relatively small amount flows to the intake-side channel 35 via the lower narrow portion 42*b*. Thus, a larger amount of cooling water W is allowed to flow to the exhaust-side channel 34, as compared with the intake-side channel 35. This is advantageous in cooling the exhaust side portion of the cylinder block 3, where the temperature is likely to increase, as compared with the intake side portion of the cylinder block 3, and in reducing a temperature difference between the intake side portion and the exhaust side portion of each cylinder.

In the invention, preferably, the spacer 40 may include a brim portion 46 at a lower end of an intake side portion of the spacer 40, the brim portion 46 projecting outward from the outer periphery of the spacer 40.

According to the aforementioned configuration, it is possible to restrain cooling water W from flowing from the lower end of the spacer 40 to the inside of the spacer 40 (a gap between the inner surface of the spacer 40 and the inner wall portion 35*a*). This is advantageous in preventing an increase of temperature difference between the upper portion and the lower portion of each cylinder.

In the invention, preferably, the cylinder block 3 may include a block-side discharge hole 37 formed in an intake side portion of the cylinder block 3 at the middle of the cylinder array, and configured to discharge the cooling water W from the block-side water jacket 33.

According to the aforementioned configuration, the cylinder block 3 includes the block-side discharge hole 37, which is formed in the intake side portion of the block-side water jacket 33 at the middle of the cylinder array, and configured to discharge the cooling water W. Therefore, the temperature of cooling water W flowing through the block-side water jacket 33 is gradually increased while depriving heat from the cylinders, as the cooling water W is introduced from one end side of the cylinder array, is allowed to flow from the exhaust side toward the intake side via the other end side of the cylinder array, and is discharged through the middle of the cylinder array on the intake side. According to this configuration, whereas the exhaust side portion of the cylinders on one end side of the cylinder array is cooled by cooling water W of a relatively low temperature, cooling of the intake side portion of the cylinders is not accelerated, because cooling water W hardly flows through the intake side portion of the cylinders due to the existence of the narrow portion 42. On the other hand, regarding the cylinders on the other end side of the cylinder array, both of the exhaust side portion and the intake side portion of the cylinders are cooled by cooling water W of a relatively high temperature. Therefore, when cooling is compared between the exhaust side portion and the intake side portion of each cylinder by temperature averaging, the cylinders on one end side of the cylinder array and the cylinders on the other end side of the cylinder array are substantially equally cooled. Thus, it is possible to reduce a temperature difference between the cylinders.

The invention is not limited to the foregoing exemplary embodiment. It is needless to say that various modifications and design changes are applicable as far as such modifications and design changes do not depart from the gist of the invention.

For instance, in the embodiment, the narrow portion 42, the inclined portion 43, the step portion 44, and the guide portion 45 are integrally formed with the spacer 40. Alternatively, a spacer 40 may be omitted, and a cylinder block 3 itself may have a narrow portion 42, an inclined portion 43, a step portion 44, and a guide portion 45 by modifying the inner shape of the block-side water jacket 33 so as to impart the functions of these portions 42 to 45.

Further, in the embodiment, the invention is applied to an in-line 4-cylinder diesel engine. Alternatively, the number of cylinders may be any number, as far as the number is plural. Furthermore, the invention is not limited to a diesel engine, but may be applied to a gasoline engine.

Further, in the embodiment, in the flowchart of FIG. 14, the cooling circuit control unit 101 uses, as an engine temperature, a head temperature (head combustion chamber wall surface temperature) to be estimated based on a load state of the engine 2 to be determined by the engine rotation number and the fuel injection amount. Alternatively, it is possible to use a temperature of cooling water W to be detected by the water temperature sensor 102.

This application is based on Japanese Patent Application No. 2013-031899 filed in Japan Patent Office on Feb. 21, 2013, the contents of which are hereby incorporated by reference.

Although the present invention has been fully described by way of example with reference to the accompanying drawings, it is to be understood that various changes and/or modifications will be apparent to those skilled in the art. Therefore, unless otherwise such changes or modifications depart from the scope of the present invention hereinafter defined, the changes or modifications should be construed as being included therein.

INDUSTRIAL APPLICABILITY

As described above, according to the present invention, in a multi-cylinder engine of an automobile or a like vehicle, it is possible to effectively cool a cylinder head and accelerate warming up of the engine when the engine is in a cold state. Thus, the present invention is advantageously used in the field of manufacturing multi-cylinder engines.

The invention claimed is:

1. A cooling device for a multi-cylinder engine, comprising:

a cylinder block including a block-side water jacket configured to surround a plurality of cylinder bores for an array of cylinders disposed in series;

a cylinder head including a head-side water jacket; and a coolant channel for circulating coolant by a water pump via the block-side water jacket, the head-side water jacket, and a radiator, wherein the cylinder block includes:

an inlet portion configured to introduce coolant to the block-side water jacket; and an inclined portion formed in the vicinity of the inlet portion, and configured to guide the coolant introduced through the inlet portion toward the cylinder head, from a lower end of a vertical wall portion up to a middle portion of the vertical wall portion in a cylinder axis direction, the cylinder head includes:

a head-side discharge portion configured to discharge the coolant from the head-side water jacket; and a communication path configured to communicate between the block-side water jacket and the head-side water jacket, both of the inclined portion and the communication path are formed on the one end side of the cylinder array, the inclined portion is configured to guide the coolant toward the cylinder head so that the coolant is allowed to flow into the head-side water jacket in a first direction via the communication path, and a narrow portion restricts flow in a direction opposite the first direction.

2. The cooling device for a multi-cylinder engine according to claim 1, further comprising:

a spacer disposed in the block-side water jacket between an inner wall portion of the block-side water jacket and an outer wall portion of the block-side water jacket, wherein the narrow portion and the inclined portion are formed on an outer periphery of the spacer.

3. The cooling device for a multi-cylinder engine according to claim 2, wherein a step portion is formed on an exhaust side portion of the spacer at a middle of the spacer in the cylinder axis direction.

4. The cooling device for a multi-cylinder engine according to claim 2, wherein the narrow portion includes a rib-like upper narrow portion and a rib-like lower narrow portion, each of which projects outward from the outer periphery of the spacer, and the upper narrow portion is formed to have a larger projection amount than the lower narrow portion.

5. The cooling device for a multi-cylinder engine according to claim 4, wherein the spacer includes a brim portion at a lower end of an intake side portion of the spacer, the brim portion projecting outward from the outer periphery of the spacer.

6. The cooling device for a multi-cylinder engine according to claim 2, wherein the cylinder block includes a block-side discharge portion formed in an intake side portion of the cylinder block at a middle of the cylinder array, and configured to discharge the coolant from the block-side water jacket.

7. The cooling device for a multi-cylinder engine according to claim 6, further comprising:

a control valve disposed on the coolant channel communicating with the block-side discharge portion, the control valve being operative to open and close depending on an engine temperature, wherein when the engine is in a cold state, the control valve closes the coolant channel, so that the coolant from the inlet portion is guided toward the cylinder head by the inclined portion, and the coolant is allowed to flow into the head-side water jacket from the communication path.

8. The cooling device for a multi-cylinder engine according to claim 1, wherein the inclined portion is formed on the one end side of the cylinder array, the inclined portion being a climbing inclination directing from an intake side toward an exhaust side.

9. A cooling device for a multi-cylinder engine, comprising:

a cylinder block including a block-side water jacket configured to surround a plurality of cylinder bores for an array of cylinders disposed in series;

a spacer disposed in the block-side water jacket between an inner wall portion of the block-side water jacket and an outer wall portion of the block-side water jacket;

a cylinder head including a head-side water jacket; and a coolant channel for circulating coolant by a water pump via the block-side water jacket, the head-side water jacket, and a radiator, wherein the cylinder block includes:

an inlet portion configured to introduce coolant to the block-side water jacket; and an inclined portion formed in the vicinity of the inlet portion, and configured to guide the coolant introduced through the inlet portion toward the cylinder head, from a lower end of a vertical wall portion up to a middle portion of the vertical wall portion in a cylinder axis direction, the cylinder head includes:

a head-side discharge portion configured to discharge the coolant from the head-side water jacket; and a communication path configured to communicate between the block-side water jacket and the head-side water jacket, the inclined portion is configured to guide the coolant toward the cylinder head so that the coolant is allowed to flow into the head-side water jacket in a first direction via the communication path, a narrow portion restricts flow in a direction opposite the first direction, a step portion is formed on the spacer at a middle of the spacer in the cylinder axis direction, the narrow portion and the inclined portion are formed on an outer periphery of the spacer, and a gap exists between an upper portion of the spacer and the outer wall portion of the block-side water jacket.

10. A cooling device for a multi-cylinder engine, comprising:

a cylinder block including a block-side water jacket configured to surround a plurality of cylinder bores for an array of cylinders disposed in series;

a spacer disposed in the block-side water jacket between an inner wall portion of the block-side water jacket and an outer wall portion of the block-side water jacket;

a cylinder head including a head-side water jacket; and a coolant channel for circulating coolant by a water pump via the block-side water jacket, the head-side water jacket, and a radiator, wherein the cylinder block includes:

an inlet portion configured to introduce coolant to the block-side water jacket; and an inclined portion formed in the vicinity of the inlet portion, and configured to guide the coolant introduced through the inlet portion toward the cylinder head, from a lower end of a vertical wall portion up to a middle portion of the vertical wall portion in a cylinder axis direction, the cylinder head includes:

a head-side discharge portion configured to discharge the coolant from the head-side water jacket; and a communication path configured to communicate between the block-side water jacket and the head-side water jacket, the inclined portion is configured to guide the coolant toward the cylinder head so that the coolant is allowed to flow into the head-side water jacket in a first direction via the communication path, a narrow portion restricts flow in a direction opposite the first direction, a step portion is formed on the block-side water jacket at a middle of the spacer in the cylinder axis direction, the narrow portion and the inclined portion are formed on an outer periphery of the spacer, a lower portion of the spacer is configured to cover the outer wall portion of the block-side water jacket, and the inclined portion extends from the inlet portion to the step portion.

* * * * *